United States Patent [19]

Ostrowsky et al.

[11] 3,954,114

[45] May 4, 1976

[54] LIPSTICK CASE

[75] Inventors: Efrem M. Ostrowsky, Highland Park; William G. Crowle, Deerfield, both of Ill.; Thomas H. Hayes, Westport, Conn.

[73] Assignee: VCA Corporation, Baton Rouge, La.

[22] Filed: Dec. 19, 1974

[21] Appl. No.: 534,197

Related U.S. Application Data

[63] Continuation-in-part of Ser. No. 439,500, Feb. 4, 1974, abandoned.

[52] U.S. Cl. ..... 132/88.7; 401/59

[51] Int. Cl.[2] ..... A45D 40/26

[58] Field of Search ..... 132/88.7, 88.5; 401/59

[56] References Cited

UNITED STATES PATENTS

| | | | |
|---|---|---|---|
| 1,810,249 | 6/1931 | Koehler | 401/59 |
| 1,948,074 | 2/1934 | Matheret et al. | 401/59 |
| 1,955,295 | 4/1934 | Hickox | 401/59 |

*Primary Examiner*—G. E. McNeill
*Attorney, Agent, or Firm*—H. Gibner Lehmann; K. Gibner Lehmann; E. Donald Mays

[57] ABSTRACT

A dispensing holder for lipstick and the like, comprising an essentially cylindrical casing having an opening at one end containing a product-carrying cup which is movable between advanced and retracted positions. A flexible pushpull actuator strap disposed in the casing has one end connected to the cup to actuate the same, and has at its other end a concavo-convex closure member of arcuate cross section. A finger piece extends through a longitudinal slot in the casing and is connected to the strap. The cup, strap and closure member are guided and controlled by an internal guide member which is closely confined within the casing, all in such a manner that the casing can be completely cylindrical. The push-pull strap, when operated by the finger piece, can advance or retract the cup and the product contained therein, and simultaneously effect retracting or advancing movement, respectively of the closure member. The top end of the casing has a lip or rim characterized by a pair of opposite convex portions joined to each other by a pair of opposite concave portions, whereby the rim lies in a curved, undulating surface. The closure member is similarly curved such that when the latter is in the closed or sealing position, an especially effective, substantially tight seal is realized whereby the likelihood of contamination of the product stick by debris and the like is greatly minimized.

19 Claims, 24 Drawing Figures

36
13
28
14
34
40
13
48
10
12

34

10
12

28
14
6
34
36
32
38
40
48
44
9
9
112
10
110
10
10
20
42
12
46
106
6

18

36
14
28
34
22
48
44
56
12
10
18
52
20
42
16
8
8
46
86
92
98
96
94
104
106
24
26
80
109
102
108

16
34
36
86
12
44
30
56
52
10
22
42
20
28
11
11
46
48
80
94
106
24
104
109
26
108

32
34
10
38
40
28
36
48

48
106
102
10
26

LIPSTICK CASE

CROSS REFERENCE TO RELATED APPLICATIONS

This application is a continuation-in-part of copending application Ser. No. 439,500, filed Feb. 4, 1974 now abandoned, and entitled "Lipstick Case." Other related copending applications are: application Ser. No. 487,309, filed July 10, 1974, and entitled "Cosmetic Holder and Applicator," which application is a continuation of Application Ser. No. 323,838, filed Jan. 15, 1973 now abandoned, and entitled "Cosmetic Holder and Applicator," now abandoned; application Ser. No. 449,643, filed Mar. 11, 1974, and entitled "Cosmetic Applicator," which application is a continuation of application Ser. No. 764,145, filed Oct. 1, 1968 now abandoned, and entitled "Cosmetic Holder," now abandoned; and application Ser. No. 453,948, filed Mar. 22, 1974, and entitled "Flat Top One-Hand Cylindrical Lipstick Case." All of the foregoing applications are assigned to the same assignee as the present application.

BACKGROUND OF THE INVENTION

1. Field of the Invention

This invention relates generally to cosmetic stick holder and applicator devices such as lipstick cases, and more particularly to devices of this type which employ a flexible strap operator to actuate a movable product-carrying cup.

2. Description of the Prior Art

In the distant past a number of cosmetic stick or lipstick holders and applicators of this type have been proposed. One prior device employed a flexible push-pull strap or band which was fastened at one end to the product-carrying cup, and at its other end to a finger piece which extended outwardly through a slot in the wall of the casing. The strip traveled along a guide having a 180° bend, such that sliding movement of the finger piece in a direction away from the open end of the casing caused advancement of the cup and stick product whereby the latter would partially protrude through the open casing end. In several of these prior constructions, the free end of the actuator strip was made sufficiently long so as to be capable of extending across the open end of the casing, the strip being also wide enough to constitute a closure therefor when the cup was moved to its retracted position.

There were a number of disadvantages and drawbacks in these outmoded or unsuccessful prior devices. In virtually all the constructions, the cases were either wholly or at least in part of square or rectangular cross section. This was due to the fact that the actuator strips employed therein were of appreciable width whereby their side edges extended along widely spaced, longitudinal portions of the casing. Such rectangular dispensers were difficult to manipulate and use, since they could not be easily twirled in the manner of a cylinder, when in the hand of the user during application. It is well recognized that such rolling or twirling movement is desirable to facilitate the application of lipstick wax, for example.

In addition, these prior devices were frequently complex and difficult to assemble. Where the prior constructions employed mating casing halves, the strip and cup had to be applied to one casing half during the assembly and held in a precise, given position while the other casing half was applied. Frequently the strip and cup would undergo a slight shift in position during this step, causing difficulty in applying the second casing half to the first. As a result, the assembly time was often excessive. Finally, the prior devices were large and cumbersome in a relative sense, and were not in keeping with the aesthetic requirements of this type of cosmetic article. In addition, following the assembly of the dispenser, the filling of the product cup with the cosmetic material or lipstick often proved to be an awkard operation, since the product cup was disposed inside the casing and was not always directly accessible for such filling operations.

SUMMARY OF THE INVENTION

The above drawbacks and disadvantages of prior cosmetic holder or lipstick devices of the kind indicated are obviated by the present invention, which has for one object the provision of an improved holder and applicator of the flexible push-pull strap type, wherein the casing need not be of square or rectangular cross section, but instead can have a precisely cylindrical shape, thereby to greatly facilitate the twirling or rolling movements found to be desirable by the average user. A related object of the invention is the provision of a holder-applicator device as above characterized, which has but a single moving part, and which is constituted of a minimum number of separate pieces. Another object is the provision of a cosmetic holder device of the kind indicated, which can be readily assembled with a minimum of time and effort and with virtually no interference between the various parts during assembly. Still another object of the invention is the provision of a cosmetic holder which can be readily filled with cosmetic product after the assembly of the dispenser has been completed, wherein such filling is capable of being accomplished in an extremely simple and efficient manner, without spillage, loss or waste of the material.

The above objects are accomplished by providing a lipstick holder and applicator which comprises a hollow, essentially cylindrical casing having an opening at one end, in combination with a unique internal guide member that is closely confined within the casing. The device has a product-carrying cup that is movable longitudinally in the casing between advanced and retracted positions, and a very narrow, flexible push-pull actuator strap having one end attached to the cup. Guide means in the casing, including a direction-reversing portion, confine the strap for movement. Because the push-pull strap is very narrow, the casing can be made essentially perfectly cylindrical on the outside. A novel closure member of concavo-convex configuration is connected to the other end of the push-pull strap. The casing has a longitudinal slot which guides a finger piece, the latter being attached to the push-pull strap at a point thereon adjacent the closure member. The arrangement is such that the closure member can move along the inside surface of the casing, from a retracted position intermediate the casing ends to an advanced, tilted position wherein it extends across and closes the open end of the casing in response to sliding of the finger piece along the casing slot in a given direction. The open end of the casing has a rim characterized by a pair of opposite convex portions joined to each other by a pair of opposite concave portions. In the closed position, the concavo-convex shape of the closure member provides a relatively close fit with the rim of the open end of the casing to thereby provide a substantially tight seal of the casing and prevents contamination of the stick product therein.

Other features and advantages will hereinafter appear.

In the drawings, illustrating a preferred embodiment of the invention:

Figure 7:
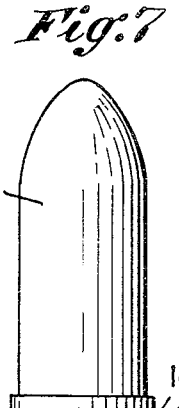
FIG. 7 is a vertical section of the holder and dispenser of FIGS. 1–6, showing the dispenser in its open condition and illustrating a product cup carried therein and disposed in the fully advanced position.
Figure 6:
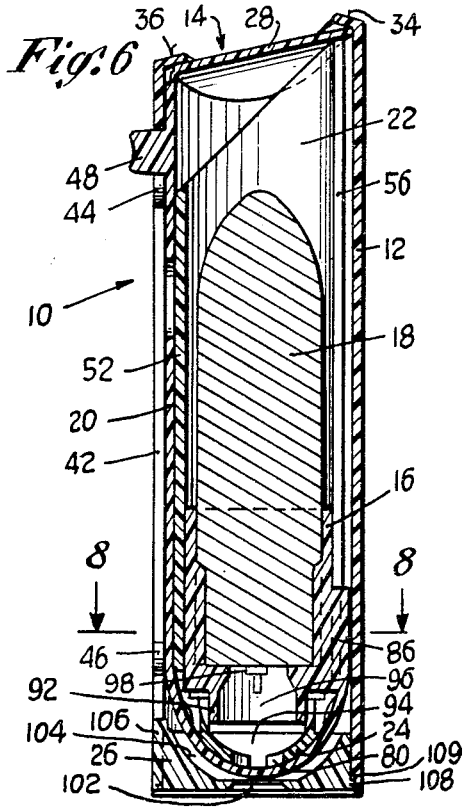
FIG. 6 is a vertical section taken on line 6—6 of FIG. 3.

Referring to FIGS. 1–7 there is illustrated a dispensing holder for lipsticks and the like, generally designated by the numeral 10, comprising an essentially circular or cylindrical outer casing 12 having an opening 14 at one end, and a strap-operated product-carrying cup 16 disposed in the casing and longitudinally movable therein between advanced and retracted positions which are illustrated respectively in FIG. 7 and FIG. 6. The cup is adapted to carry a lipstick or other cosmetic stick 18 as shown.

Figure 8:
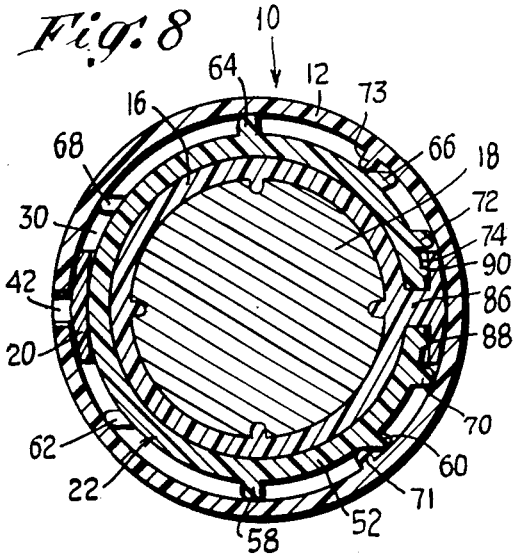
FIG. 8 is a section taken on line 8—8 of FIG. 6.
Figure 11:
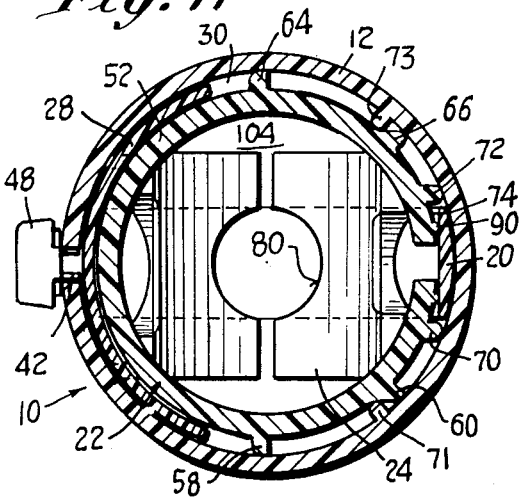
FIG. 11 is a section taken on line 11—11 of FIG. 7.
Figure 9:
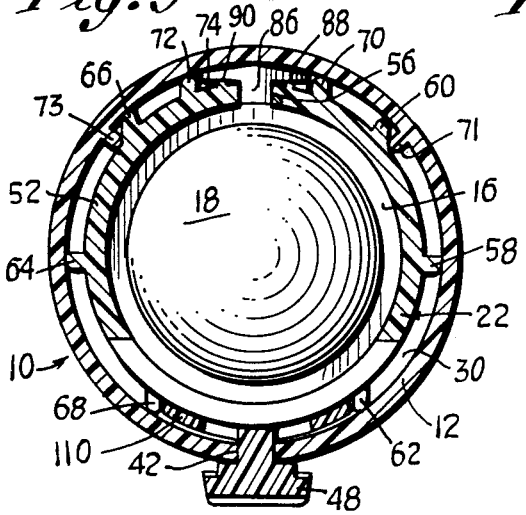
FIG. 9 is a section taken on line 9—9 of FIG. 3.
Figure 12:
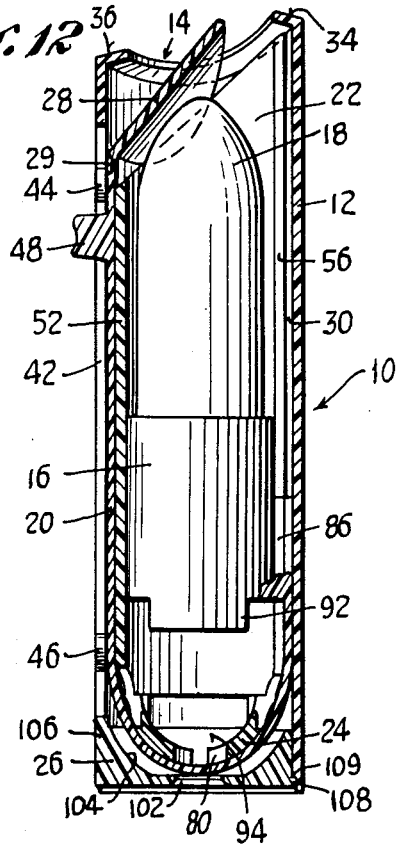
FIG. 12 is a view like FIG. 6, except illustrating the closure member in an intermediate position just prior to its being advanced to the fully closed, sealing position.
Figure 10:
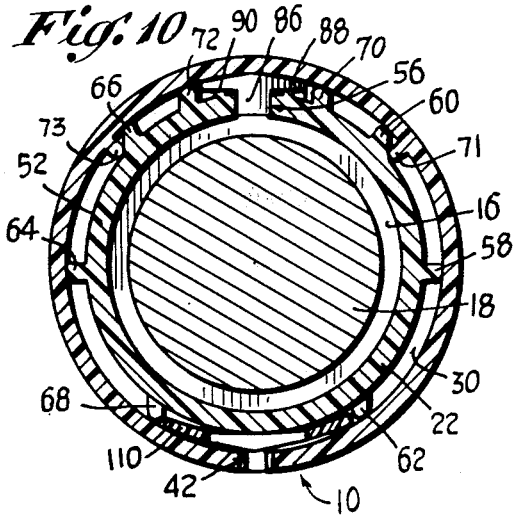
FIG. 10 is a section taken on line 10—10 of FIG. 3.
Figure 23:
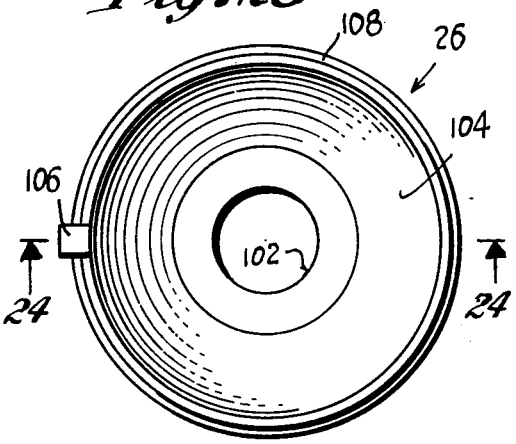
FIG. 23 is a top plan view of a closure plug which is received in one end of the casing to captively retain the strap and guide member therein following assembly.
Figure 24:
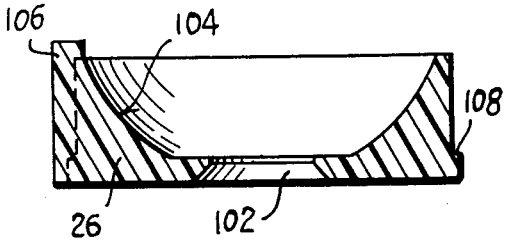
FIG. 24 is a section taken on line 24—24 of FIG. 23.

Attached to the cup 16 is one end of a push-pull actuator strap 20 which is flexible and capable of bending as it moves within the casing. The strap is guided and confined by an internal guide member 22 which has a reversing guide portion 24. The guide member is illustrated particularly in FIGS. 15–19, and is held captive in the outer casing 12 by means of a closure plug 26 (FIGS. 23, 24), the plug being received in the end of the casing opposite the opening 14. Carried by the other end of the strap 20 by means of a bendable, resilient hinge 29 is a thin, wafer-like closure member 28 which is movable between an advanced or sealing position wherein it spans the top or opening of the casing, and a retracted position wherein it partially fills a curved space between the outer casing 12 and the internal guide member 22. The curved space is designated by the numeral 30 in FIGS. 8–10, and in FIG. 11 the closure member 28 is shown occupying this curved space.

Figure 1:
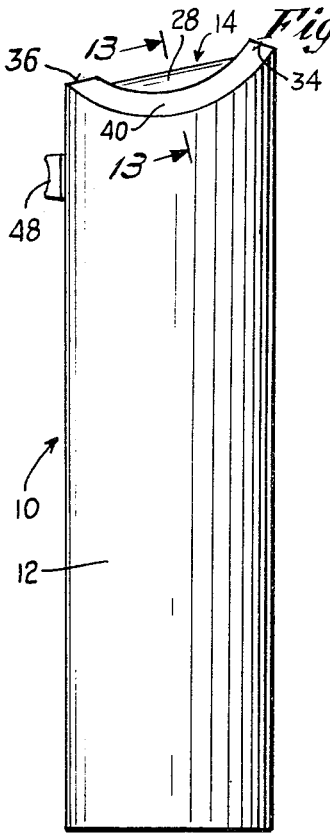
FIG. 1 is a side elevational view of the cosmetic holder and dispenser of the present invention, comprising a cylindrical casing having an internal guide member and a closure member, the latter being shown in the fully closed, sealing position.
Figure 2:
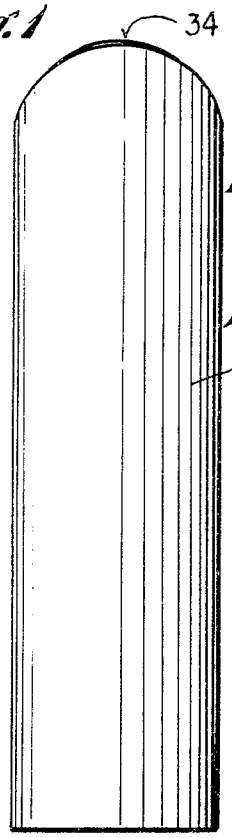
FIG. 2 is a front elevational view of the holder and dispenser of FIG. 1.
Figure 3:
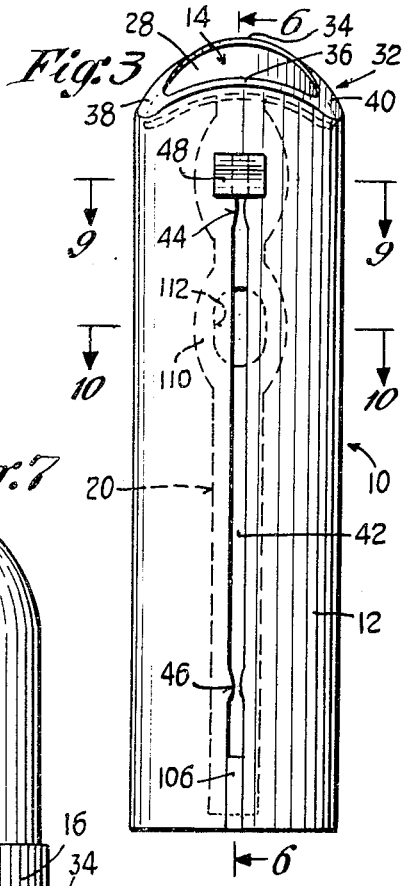
FIG. 3 is a rear elevational view of the holder and dispenser of FIGS. 1 and 2.
Figure 4:
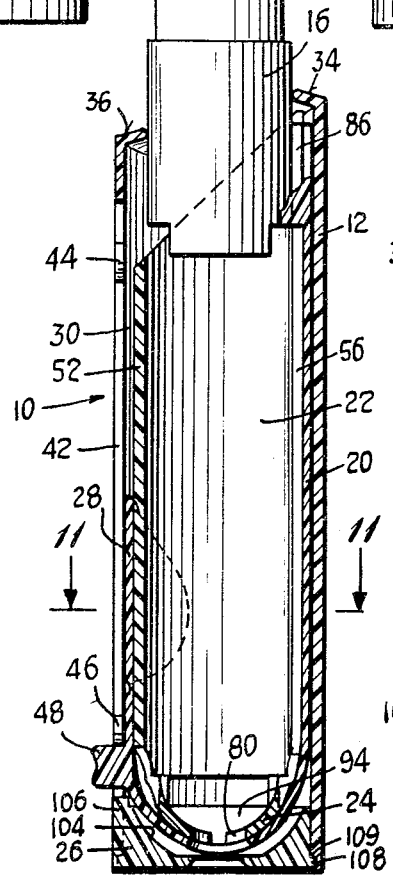
FIG. 4 is a top plan view of the holder and dispenser of FIGS. 1–3.
Figure 4:
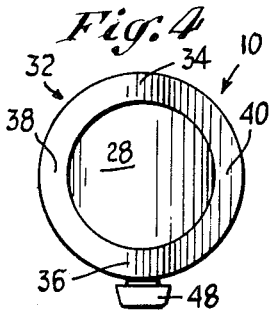
Figure 5:
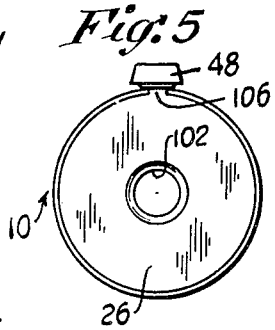
FIG. 5 is a bottom plan view of the holder and dispenser.
Figure 14:
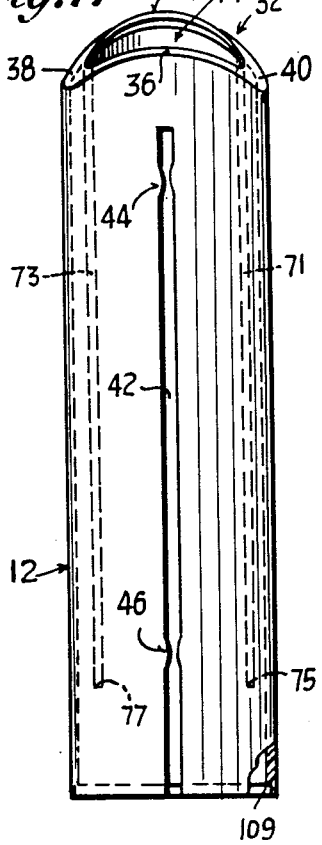
FIG. 14 is a rear elevational view of the casing portion per se of the holder and dispenser of FIGS. 1–13.
Figure 15:
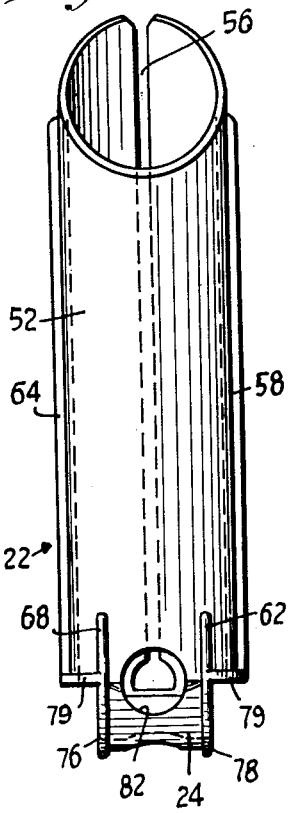
FIG. 15 is a rear elevational view of the internal guide member per se of the holder and dispenser of FIGS. 1–13.
Figure 16:
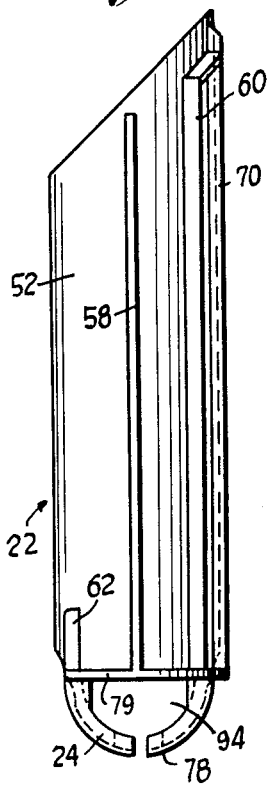
FIG. 16 is a side elevational view of the internal guide member of FIG. 15.
Figure 18:
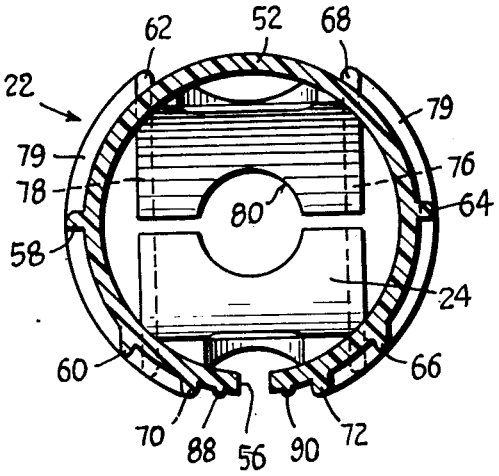
FIG. 18 is a section taken on line 18—18 of FIG. 17.
Figure 19:
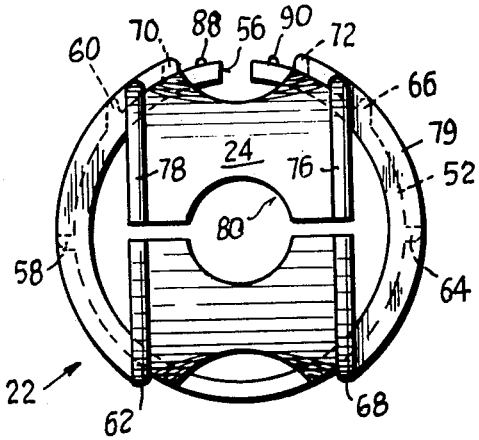
FIG. 19 is a bottom plan view of the internal guide member of FIGS. 15–17.

Referring to FIGS. 3–4 and 14, and in accordance with the present invention, the opening 14 at the top end of the casing has a rim 32 characterized by a pair of opposite convex portions 34, 36 joined to each other by a pair of concave portions 38, 40. The rim lies in a curved or undulating surface which has a unique shape which greatly contributes to an effective seal of the dispenser when the closure member is spanning the open end. The closure member 28, being thin and resilient, is capable of undergoing limited flexing when moving between advanced and retracted positions. In the latter position, the member is confined by the walls of the outer casing 12 and of the internal guide member 22, and thus assumes a partially cylindrical, concavo-convex surface configuration. We have found that by forming the rim 32 of the casing as indicated above, the closure member is not required to undergo any substantial change in shape when it is moved from the retracted to the advanced positions. By such an arrangement, any tendency for the member 28 to take a "set" when in the retracted position will not disrupt proper, smooth operation of the dispenser, since the rim has been given a curved, concavo-convex configuration especially well adapted to receive the member in in this "set" condition; moreover the rim tends to maintain the curved shape of the closure member when the latter is in the advanced position (FIG. 6) such that subsequent movement to its retracted position is facilitated without any interference or obstruction from the internal guide member.

Referring to FIGS. 3, 6, 7 and 14, the casing 12 is seen to be elongate and has a longitudinal slot 42 extending substantially along its entire length. The slot has a generally uniform width, except for a pair of detent nibs 44 adjacent the open end of the casing and a second pair of detent nibs 46 disposed adjacent the closed end of the casing. The actuator strap 20 has a finger piece 48 which is externally engageable by the fingers of the user to effect advancing and retracting movement of the product cup and simultaneous actuation of the closure member 28. The finger piece 48 is attached to the strap by a bridge 50 (FIGS. 20, 21) which is received in the slot 42 of the outer casing. The detent nibs 44 provide increased resistance to the sliding movement of the bridge, and thus maintain the latter in a given position corresponding to the fully advanced position of the closure member 28 (corresponding to the fully retracted position of the product cup 16) as shown in FIG. 6. The nibs 44 also provide an increased drag which is sensed by the user when the closure member is being moved from an intermediate position to its fully advanced position. Such a momentary "resistance" gives the user an indication that he has almost arrived at the fully closed position; and is advantageous because it eliminates the need for observing the dispenser during the closing operation in order to verify that it is indeed closed. Similarly, the detent nibs 46 serve to hold the bridge 50 in position when the dispenser has been actuated to its fully open, (advanced cup) position shown in FIG. 7. Again, during such opening, the nibs provide a momentary "drag" to notify the user that the end or stop limit of the device is nearing.

Referring now particularly to FIGS. 15–19, the internal guide member 22 is elongate and comprises an annular wall portion 52 extending substantially for 360°, and a direction-reversing guide portion 24 disposed near one end. The guide member 22 has a longitudinal slot 56 extending substantially the entire length thereof. The annular wall 52 has a series of longitudinal positioning ribs 58, 60, 62, 64 and 66, 68, on its exterior surface which are adapted to engage the inside wall of the outer casing, and thus space the internal guide member therefrom, the ribs tending to maintain it in a centralized position. Also disposed on the exterior surface of the guide member is a pair of longitudinal guide ribs 70, 72 extending substantially parallel to the slot 56 and disposed on opposite sides thereof. The ribs 70, 72 together with the annular wall 52 on either side of the slot 56, and the inner surface of the casing 12, provide a channel 74 (FIG. 11) to closely confine a portion of the strap along its path of movement. The guide ribs 70, 72 also serve to help maintain the internal guide member centralized with respect to the casing 12.

FIGS. 8–11 and 14 illustrate two elongate positioning ribs 71, 73 on the inner surface of the outer casing 12 which also extend substantially the entire length thereof. The ribs 71, 73 are adapted to engage the external ribs 60, 66 respectively on guide member 22 to thereby maintain the latter in a fixed position in the casing and prevent relative rotation with respect thereto. In accomplishing this, the ribs also have end portions 75, 77 adjacent the closed end of the casing. Following assembly of the casing, these ends engage an external annular bead 79 on the outer surface of the internal guide member to limit the extent of insertion of the latter into the outer casing to a predetermined position, as will be explained in further detail below.

FIGS. 15–19 also show the details of the direction-reversing guide portion 24. This guide portion is curved as shown, extends through an arc of 180°, and has a pair of spaced-apart flanges 76, 78 which provide centralization for a particular portion of the actuator strap to be described later. The guide has a hole 80 at its center, the center of the hole being substantially in alignment with the major axis of the guide member. This hole facilitates filling of the product cup from the bottom of the dispenser after the latter has been fully assembled. The additional holes 82, 84 facilitate the removal from the molds of the guide member following the molding of the same.

Referring now to FIGS. 6, 7, 12 and 21, it can be seen that the actuator strap is fastened to the product cup 16 by means of a bridge 86. Preferably, the product cup 16, actuator strap 20, finger piece 48 and closure member 28 are molded as a single, integral piece as in FIGS. 20, 21. The bridge 86 is adapted to be received in the slot 56 of the internal guide member (from the open end thereof), such that the product cup 16 can freely slide longitudinally therein. To minimize friction and eliminate any tendency toward bending of the strap and cup, there are provided on the exterior surface of the guide member a pair of longitudinal bearing slide ribs 88, 90 disposed closely adjacent and on opposite sides of the slot 56. These engage the strap at only limited points and thus minimize the contact area between it and the guide member.

Referring again to FIGS. 20–22, the product cup has a rectangular portion 92 at the periphery of its bottom, which is adapted to be extended partially past the area of the annular wall adjacent the annular bead 79 and into the hollow space 94 inside the direction-reversing guide. This arrangement permits the cup, when in its retracted position, to be as close to the bottom end of the casing as possible, thus minimizing the required overall length of the casing. The cup also has a hole 96 in its bottom which enables it to be filled by means of a long tube extending therethrough and through the bottom of the casing after the latter has been completely assembled. A series of projections 98 extending into the interior of the cup are adapted to secure a solidified cosmetic stick after it has been injected into the cup in liquid form and allowed to harden.

The assembled dispenser has a closure plug 26 in the form of a circular disk which is received in the end of the casing opposite the open top end 14, and held captive therein by a sonic weld or other suitable fastening means. The plug 26 is illustrated particularly in FIGS. 23 and 24. As shown, the plug has a hole 102 substantially at its center, which facilitates filling of the product cup 16 of the dispenser after the latter is completely assembled. The plug has a hollow inner wall surface 104 of generally concave configuration, the surface being adapted to engage and confine intermediate portions of the actuator strap 20 as it moves along the direction-reversing guide portion 24 (FIGS. 6, 7). The plug 100 has a positioning key 106 which is received in the casing slot 42 during assembly. This orients the plug and also provides a smooth, continuous annular surface to the casing near its bottom, since the slot 42 in this vicinity is fully occupied by the key 106. A shoulder 108 in the plug abuts a corresponding internal shoulder 109 adjacent the bottom rim of the casing 12.

Figure 20:
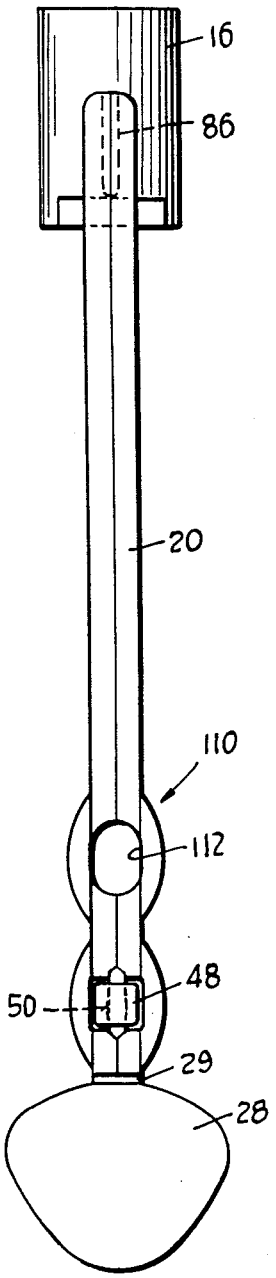
FIG. 20 is a front elevational view of a one-piece push-pull actuator strap and product carrier cup carried thereby as employed in the dispenser of the present invention.
Figure 17:
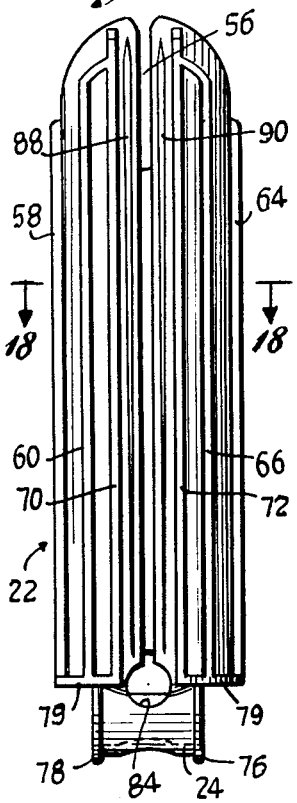
FIG. 17 is a front elevational view of the internal guide member of FIGS. 15 and 16.

The above construction is extremely well adapted for maximum ease of assembly and minimum assembly time. Referring to FIGS. 20 and 17, the product cup 16 is first inserted into the open end of the guide member 22 such that the bridge 86 is received in the slot 56, with the actuator strap 20 extending toward the direction-reversing guide portion 24. The strap 20 is then bent around the reversing guide portion and the closure member swung to a position adjacent the guide member annular wall 52 diametrically opposite the location of the slot 56. This assembly is then inserted into the casing 12 through the open bottom thereof such that the bridge 50 of the finger piece 48 is received in the outer casing slot 42. The insertion is completed when the end portions 75, 77 of the internal positioning ribs 71, 73 respectively engage the annular external bead 79 on the guide member. The shoulder 108 of the closure plug 100 is then seated against a corresponding internal shoulder 109 on the bottom rim of the casing, after which the plug is welded or cemented thereto.

In operation, the product cup 16 is movable between an advanced position illustrated in FIG. 7 and a retracted position illustrated in FIG. 6, by means of the strap 20, which is in turn actuated by the finger piece 48. It will be understood that as this is done, the opposite end portions of the strap 29 move in ooposite but substantially parallel directions, with the intermediate portion of the strap extending through a bend of approximately 180 degrees as it traverses the reversing guide portion 24. During its movement along the reversing guide, the strap is confined by the same and by the hollow, inner surface 104 of the closure plug 100. By the above arrangement, an especially convenient, smooth one-hand operation is achieved, with a perfectly cylindrical lipstick casing.

In accomplishing a bottom fill of the assembled container, the actuator strap 20 is provided with an offset portion 110 in the form of an enlargement with an opening 112. It will be understood that the actuator strap 20 can be moved to a position wherein the opening 112 is in exact alignment with the hole 80 in the reversing guide portion 24, and with the hole 102 of the closure plug 100. The spaced apart flanges 76, 78 of the direction-reversing guide portion 24 centralize the opening 112 of the strap with respect to the hole 80 in the reversing guide portion. This "fill" position would be identical to the fully advanced position (FIG. 7) of the dispenser. Note that for this condition, part of the product cup 16 extends beyond the rim 32 such that a molding cap could be temporarily applied thereto. Suitable filling apparatus (not shown) could then apply liquid product through a tube inserted through the holes in the closure plug, strap, and guide member reversing guide portion, and through the opening or hole 96 in the bottom of the product cup 16. Following completion of the filling, the tube is withdrawn. Upon solidification of the cosmetic stick, the cap can be removed from the cup 16, and the latter fully retracted to the position of FIG. 6, which is suitable for storage, shipping or display, etc.

Figure 21:
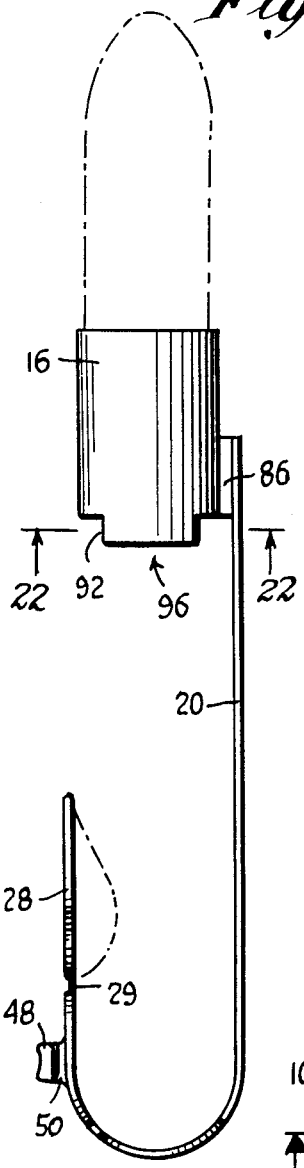
FIG. 21 is a side elevational view of the strap and cup of FIG. 20, wherein the strap has been bent to simulate its position during movement inside the casing of the dispenser.
Figure 22:
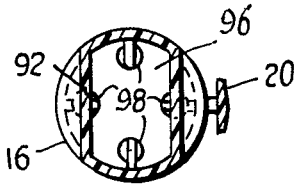
FIG. 22 is a section taken on line 22—22 of FIG. 21.

It will be noted in FIGS. 20–22 that the strap 20 has an opening immediately adjacent the finger piece 48. This results from molding, and enables the cup, strap, and finger piece to be constituted as a single piece.

Figure 13:
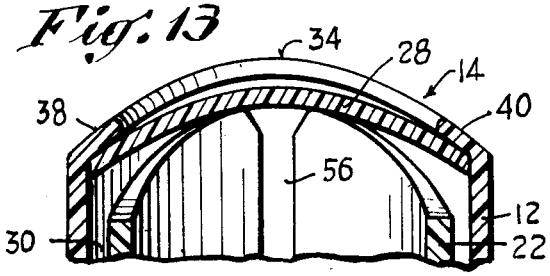
FIG. 13 is a section taken on line 13—13 of FIG. 1.

The above construction is seen to have a number of distinct advantages. The dispenser consists essentially of four separate parts, which can be easily and economically molded in simple mold cavities. By virtue of the closure member assuming a concavo-convex configuration due to confinement between the casing and the internal guide member, a substantially tight seal is realized during its engagement with the rim. In this connection, since the closure member as originally molded is flat, it may have a concavo-convex curvature that is somewhat less than the curvature of the rim portion of the casing when the closure member is in the advanced position. By such arrangement, the ears of the closure member will more tightly engage the opposite portions 38, 40 of the rim 32 when the closure member is moved to the fully advanced position as seen in FIG. 13. We have found that this provides an especially effective, substantially tight seal of the lipstick dispenser and represents a highly desirable feature from the standpoint of the consumer. Assembly of the dispenser is greatly facilitated due to the special configuration of the internal guide member, in combination with an outer casing which is adapted to receive the guide member from its bottom. By virtue of the longitudinal bearing slide ribs 88, 90 on the outer surface of the guide member, an especially friction-free and smooth advancing movement of the product cup is realized. We have found that this arrangement is not at all susceptable to binding or seizing, and thus the reliability of the dispenser under adverse conditions of use has been found to be exceptional. In addition, the capability of filling the assembled dispenser through the bottom greatly minimizes the time required and results in a minimum spillage or waste of stick product.

From the foregoing it can be seen that we have provided a novel and improved lipstick dispenser which is extremely simple in construction and economical to manufacture, while providing highly reliable performance. The dispenser is thus seen to represent a distinct advance and improvement in cosmetic stick dispenser technology.

Variations and modifications are possible without departing from the spirit of the invention.

We claim:

1. A dispensing holder for lipsticks and the like, comprising, in combination:

a. a substantially cylindrical casing having an open top end, b. a thin, wafer-like closure member disposed in the casing and adapted to span the open end thereof, c. a flexible push-pull strap connected to said closure member and having an exposed finger piece, d. guide means on the casing to guide said strap and closure member for movement between a retracted position wherein the closure member is removed from said open end and closely underlies a side portion of the casing, and an advanced position wherein the closure member spans the casing top and closes said open end, e. said open top end of the casing having a rim characterized by a pair of opposite convex portions joined to each other by a pair of opposite concave portions whereby said rim lies in a curved, undulating surface, f. said closure member being concavo-convex for both its retracted and its advanced positions, and closely fitting said top rim when advanced, so as to constitute a substantially tight closure therefor.

2. The invention as set forth in claim 1, wherein:

a. said casing is tubular and elongate, and has a longitudinally extending slot in one wall forming part of the guide means, b. said finger piece comprising a bridge extending through said slot and terminating in an external enlargement engageable by the fingers, c. said slot having a detent nib adjacent one end for frictionally engaging the bridge when the closure member is disposed in its full advanced position spanning the open end of the casing.

3. The invention as set forth in claim 1, wherein:

a. said casing is tubular and elongate, and has a longitudinally extending slot in one wall, b. said finger piece comprising a bridge extending through said slot, and terminating in an external enlargement engageable by the fingers, c. said slot having a detent nib adjacent one end for frictionally engaging the bridge when the closure member is disposed in its retracted position.

4. The invention as set forth in claim 1, and further including:

a. a hinge connecting said strap and said closure member for enabling limited pivotal movement of the latter when it is moving between its retracted position, and its fully advanced position wherein it spans the open end of the casing.

5. The invention as set forth in claim 4, wherein:

a. said rim comprises oppositely disposed, inwardly facing flange portions, b. corresponding peripheral edge portions of said closure member engaging said flange portions to be guided thereby as the closure member is moved from a retracted position to its fully advanced position, c. said engagement causing pivoting of the closure member with respect to the strap about said hinge.

6. The invention as set forth in claim 1, and further including:

a. an elongate internal guide member of tubular configuration, adapted to be received in said casing, b. said guide member having an annular wall which, together with the wall of the cylindrical casing defines a curved space therebetween, c. said closure member being received in said curved space when it is disposed in a retracted position.

7. The invention as defined in claim 6, wherein:

a. said casing is tubular and elongate, and has a longitudinally extending slot in one wall, b. said finger piece comprising a bridge extending through said slot and terminating in an external enlargement engageable by the fingers, c. the casing wall on either side of the slot, and the annular wall of the guide member constituting part of said guide means for a portion of the strap along its path of travel.

8. The invention as defined in claim 6, wherein:

a. said guide member has a direction-reversing guide at its end opposite the location of the open end of the casing, b. intermediate portions of said strap overlying and engaging said reversing guide as the strap is moved along its path of travel.

9. The invention as defined in claim 6, and further including:

a product carrier cup disposed inside the internal guide member and longitudinally movable therein between advanced and retracted positions, b. said guide member having a longitudinal slot extending substantially the entire length thereof, and c. a bridge joining the cup to one end of the strap, d. said bridge being movable along said guide member slot as the product cup is moved between advanced and retracted positions.

10. The invention as set forth in claim 6, wherein:

a. said guide member has a longitudinal slot extending substantially the entire length thereof, and b. a pair of longitudinally extending guide ribs disposed on opposite sides of said slot, c. said ribs and a portion of the wall of the casing engaging one another and providing a channel which confines and guides one end of the strap along its path of travel.

11. The invention as defined in claim 6, wherein:

a. said guide member has on its outer surface a plurality of longitudinal positioning ribs, b. said casing having on its inner surface cooperable positioning ribs engageable with the positioning ribs of the guide member to maintain the latter centralized with respect to the casing and prevent relative rotation therebetween.

12. The invention as defined in claim 6, and further including:

a. a disk-shaped closure plug received in the end of the casing opposite said open end, b. said closure plug permanently retaining said internal guide member in place.

13. The invention as defined in claim 12, wherein:

a. said closure plug is circular and has a hole substantially at its center, b. said strap having an edgewise-offset portion adjacent the location of the closure member, c. said reversing guide having a hole substantially in alignment with said closure plug hole, d. a product carrier cup disposed inside the internal guide member and longitudinally movable therein between advanced and retracted positions, e. said cup having an opening at its bottom which is substantially in alignment with the holes of the closure plug and the reversing guide, to facilitate filling of the product cup with liquefied stick product from the bottom of the dispenser by insertion of a supply tube past the offset portion of the strap and through said two holes and said opening into the cup.

14. The invention as set forth in claim 13, wherein:

a. said offset portion of the strap comprises an enlargement thereof having a central opening of substantially circular configuration, b. said central opening being capable of aligning with the hole in the reversing guide and the hole in the closure plug when the strap is moved to a predetermined position.

15. The invention as defined in claim 14, wherein:

a. said direction reversing guide has a pair of spaced-apart flanges to provide a guide for the strap enlargement when the central opening of the latter is in alignment with the hole in the direction reversing guide.

16. The invention as defined in claim 9, wherein:

a. said strap, finger piece, closure member and product carrier cup are integral with one another and are constituted of resilient plastic substance.

17. The invention as set forth in claim 12, wherein:

a. said closure plug has a hollow inner wall surface adjacent the direction-reversing guide of the guide member, b. said wall surface having a generally concave configuration, c. intermediate portions of said strap engaging said surface and said direction reversing guide as the strap moves along its path of travel.

18. The invention as set forth in claim 12, wherein:

a. said casing is tubular and elongate, and has a key slot in one wall, b. said closure plug having keying means receivable in said key slot for orienting the plug with respect to the casing.

19. The invention as defined in claim 9, wherein:

a. the product carrier cup when disposed in an advanced position extends at least partially beyond the uppermost surface of the rim to facilitate the application of a mold cavity over the open top of the cup during filling of the same with cosmetic product.

* * * * *